US011873654B1

(12) United States Patent
Johnson

(10) Patent No.: US 11,873,654 B1
(45) Date of Patent: Jan. 16, 2024

(54) FENCE INSTALLATION APPARATUS

(71) Applicant: Travis Johnson, Tallahasse, FL (US)

(72) Inventor: Travis Johnson, Tallahasse, FL (US)

( * ) Notice: Subject to any disclaimer, the term of this patent is extended or adjusted under 35 U.S.C. 154(b) by 686 days.

(21) Appl. No.: 16/940,906

(22) Filed: Jul. 28, 2020

Related U.S. Application Data

(60) Provisional application No. 63/036,504, filed on Jun. 9, 2020.

(51) Int. Cl.
*E04H 17/26* (2006.01)
*E02D 7/00* (2006.01)

(52) U.S. Cl.
CPC ..... *E04H 17/263* (2013.01); *E04H 17/26* (2013.01); *E04H 17/266* (2013.01); *E02D 7/00* (2013.01)

(58) Field of Classification Search
CPC ..... E04H 17/263; E04H 17/266; E04H 17/02; E04H 17/26; E04H 17/261; E04H 17/127; E21B 7/005; E21B 7/028; E02D 7/00
USPC ..... 173/53, 44, 27, 184, 46, 90, 190
See application file for complete search history.

(56) References Cited

U.S. PATENT DOCUMENTS 2,776,110 A * 1/1957 Hoistad ..... E02D 7/20 254/29 R
3,703,934 A * 11/1972 Cartner ..... E04H 17/263 173/193
3,752,242 A * 8/1973 Gremillion ..... E21B 7/026 173/147
3,934,655 A * 1/1976 Whistle ..... E04H 17/261 173/28
4,050,526 A * 9/1977 Deike ..... E21B 7/028 173/147
4,051,684 A * 10/1977 Fulkerson ..... E02D 7/08 52/103
5,107,592 A * 4/1992 Downey ..... A01G 3/0417 30/379.5
5,490,568 A * 2/1996 Rios ..... E04H 17/263 405/303
5,494,117 A * 2/1996 Aldridge ..... E02D 7/10 212/253
6,517,294 B2 * 2/2003 Vreeland ..... E02F 5/101 173/90
6,591,919 B1 * 7/2003 Herrmann ..... E02D 7/10 173/27
6,796,747 B1 * 9/2004 Vreeland ..... E02D 17/202 173/90

(Continued)

*Primary Examiner* — Scott A Smith
(74) *Attorney, Agent, or Firm* — Gulf Coast Intellectud Property Group

(57) ABSTRACT

A fence installation apparatus that is operably coupled to a vehicle wherein the vehicle is traversed along a desired fence line while the fence apparatus is utilized to provide installation of a fence. The fence installation apparatus includes a drive assembly support frame having a rear support member and front support member. The rear support member and the front support member having operably coupled thereto a first drive member and a second drive member. The first drive member and second drive member are configured to drive fence posts into the ground. The fence installation apparatus further includes a first wire dispenser that is rotatably mounted in order to provide distribution of a wire during fence installation. A second wire dispenser is further included to dispense a second wire and further has a pole mount and pole member coupled thereto for distribution of fence accessories.

4 Claims, 4 Drawing Sheets

(56) References Cited

U.S. PATENT DOCUMENTS

| | | | | |
|---|---|---|---|---|
| 6,945,739 | B1 * | 9/2005 | Putman | E02D 19/18 405/15 |
| 7,011,269 | B1 * | 3/2006 | Chouinard | E04H 17/266 242/594.6 |
| 7,296,636 | B1 * | 11/2007 | Vreeland | E04H 17/263 173/90 |
| 9,556,584 | B2 * | 1/2017 | Schmidt | E02F 9/2025 |
| 9,938,749 | B2 * | 4/2018 | Knudsen | G01D 21/00 |
| 10,196,229 | B2 * | 2/2019 | Smith | B65H 49/32 |
| 10,711,422 | B2 * | 7/2020 | Canteri | E02D 7/06 |
| 10,837,196 | B2 * | 11/2020 | Cowan | B65H 49/32 |
| 11,214,978 | B2 * | 1/2022 | McConnell | E04H 17/02 |
| 2011/0121125 | A1 * | 5/2011 | Stow | B66F 9/184 254/214 |
| 2016/0138299 | A1 * | 5/2016 | Powers, III | E04H 17/263 173/184 |

* cited by examiner

FENCE INSTALLATION APPARATUS

CROSS REFERENCE TO RELATED APPLICATIONS

This nonprovisional application claims priority based upon the following prior U.S. Provisional Patent Application entitled: Fence Installation Apparatus, Application No.: 63/036,504 filed Jun. 9, 2020, in the name of Travis Johnson, which is hereby incorporated by reference for all purposes.

FIELD OF THE INVENTION

The present invention relates generally to fences and installation thereof, more specifically but not by way of limitation, an apparatus operable to facilitate the installation of a fence such as a barbed wire or chain link fence.

BACKGROUND

As is known in the art, there are numerous types of fencing that are employed along property perimeters and other desired locations. Fences such as wood picket fences are commonly utilized in residential settings whereas alternate types of fencing such as barbed wire or chain link are more commonly utilized in commercial environments. For the latter, the installation involves the process of setting posts and running wire along a desired path. It is common to utilize metal posts wherein the metal posts are driven into the ground and can further be secured through materials such as but not limited to concrete.

One problem when installing a fence is the amount of time an labor required for installation. By way of example but not limitation, conventional methods of post installation can involve the use of a ladder, a drive hammer and two individuals to set a single post. The method is not only unsafe but consumes more labor hours resulting in potentially higher costs for installation. Other tasks such as but not limited to facilitating wire installation on the posts requires further labor and tools that add to the total time and cost of installation of a fence.

It is intended within the scope of the present invention to provide fence installation apparatus that is operably configured to facilitate the installation of at least two fence posts simultaneously and further provide dispensing of materials such as but not limited to wire.

SUMMARY OF THE INVENTION

It is the object of the present invention to provide a fence installation apparatus operable to facilitate the installation of a fence wherein in a preferred embodiment the apparatus of the present invention is operably coupled to a truck or suitable vehicle.

Another object of the present invention is to provide a fence installation apparatus configured to expedite installation of a fence wherein the apparatus includes a drive assembly support frame.

A further object of the present invention is to provide a fence installation apparatus operable to facilitate the installation of a fence wherein in a preferred embodiment of the present invention the drive assembly support frame includes a first support member and a second support member that extend upward from the truck and further include perpendicular support members at the upper end thereof.

Still another object of the present invention is to provide a fence installation apparatus configured to expedite installation of a fence wherein the drive assembly support frame has movably coupled thereto a first post drive member and a second post drive member.

An additional object of the present invention is to provide a fence installation apparatus operable to facilitate the installation of a fence wherein the first and second post drive members are movably coupled to the drive assembly support frame so as to facilitate an upward-downward movement thereof.

Yet a further object of the present invention is to provide a fence installation apparatus configured to expedite installation of a fence wherein the apparatus of the present invention further includes an alignment member configured to align two adjacent posts during installation thereof.

Another object of the present invention is to provide a fence installation apparatus operable to facilitate the installation of a fence that further includes a first wire-dispensing member.

An alternate object of the present invention is to provide a fence installation apparatus configured to expedite installation of a fence that further includes a second wire-dispensing member.

Still a further object of the present invention is to provide a fence installation apparatus operable to facilitate the installation of a fence wherein the present invention further includes a user safety cage.

An additional object of the present invention is to provide a fence installation apparatus configured to expedite installation of a fence wherein the second wire-dispensing member is configured to facilitate the ability to thread components onto a wire.

A further object of the present invention is to provide a fence installation apparatus operable to facilitate the installation of a fence wherein the present invention is mounted to a vehicle so as to be traversed along a path for installing a fence.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
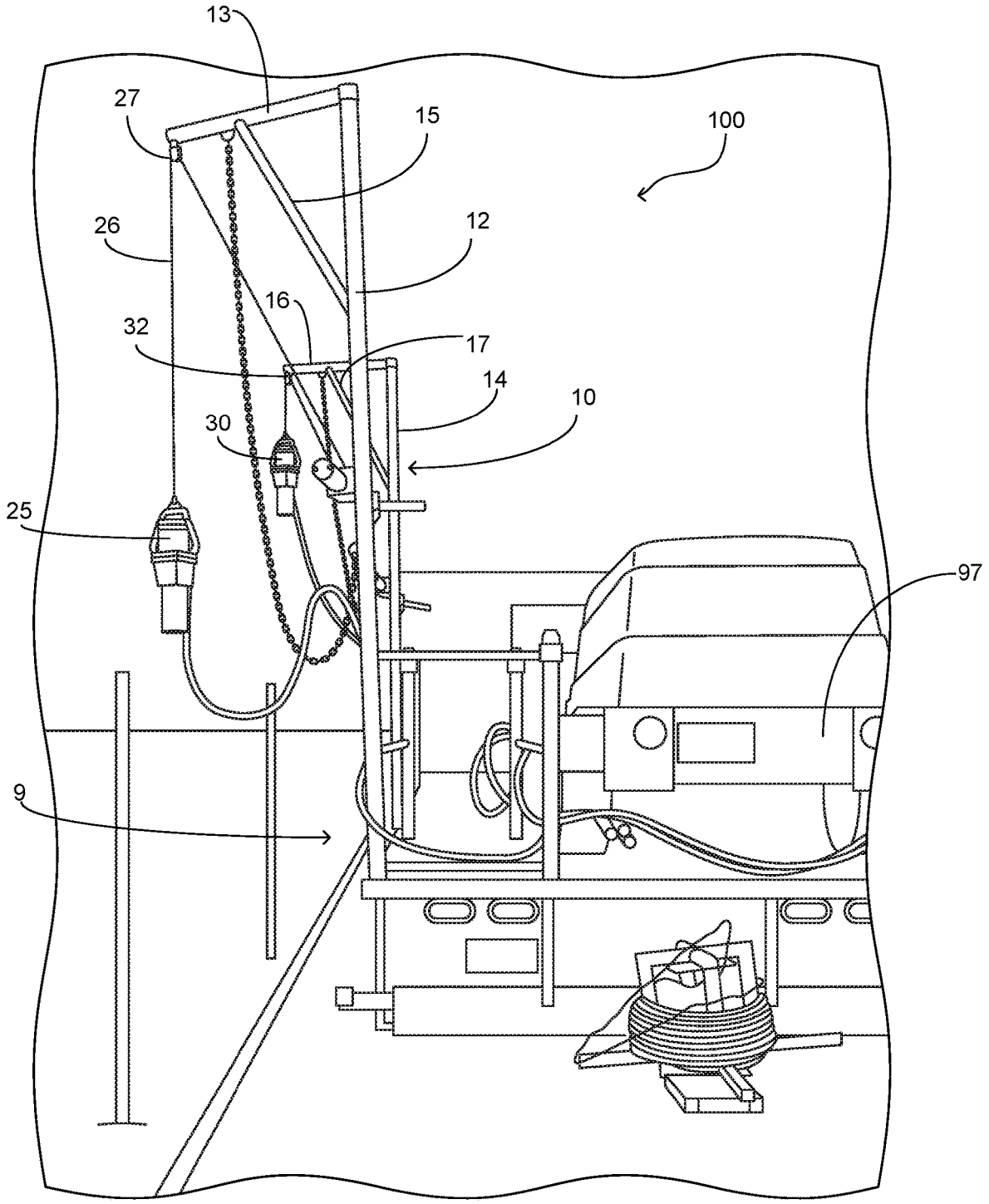
FIG. 1 is a rear perspective view of the present invention.
Figure 2:
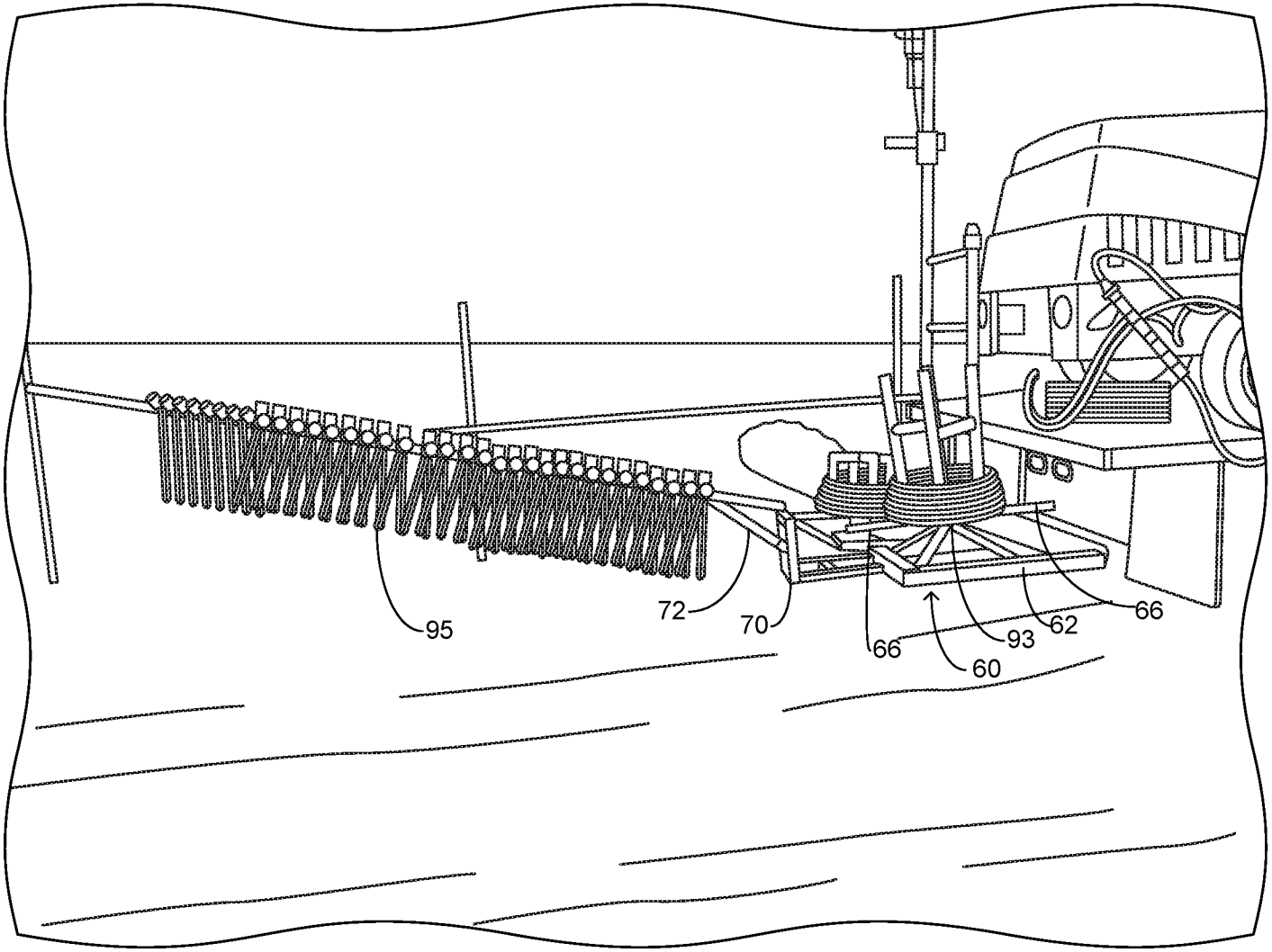
FIG. 2 is a side view of the rear assembly of the present invention.
Figure 3:
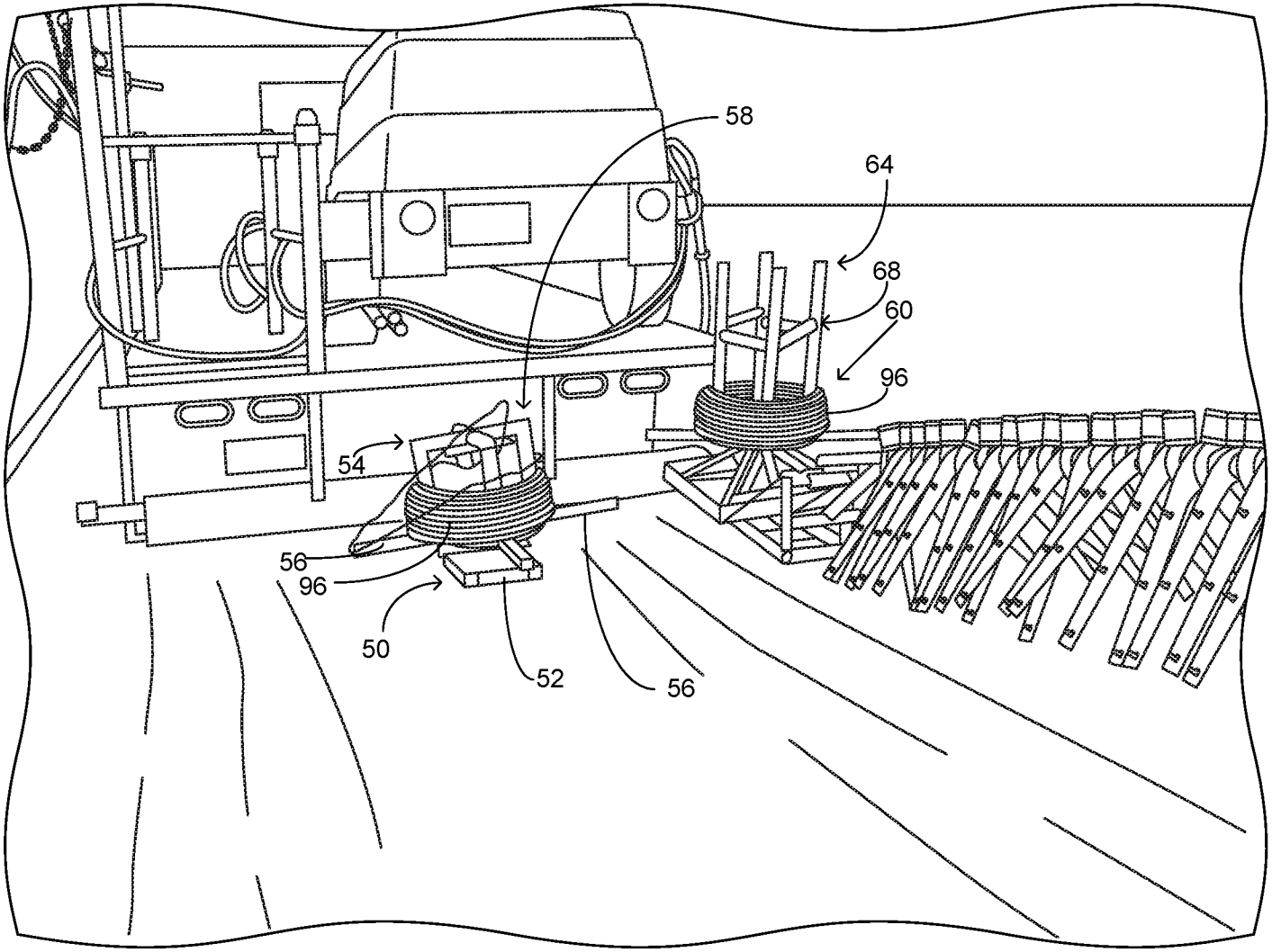
FIG. 3 is a detailed view of the rear assembly of the present invention.
Figure 4:
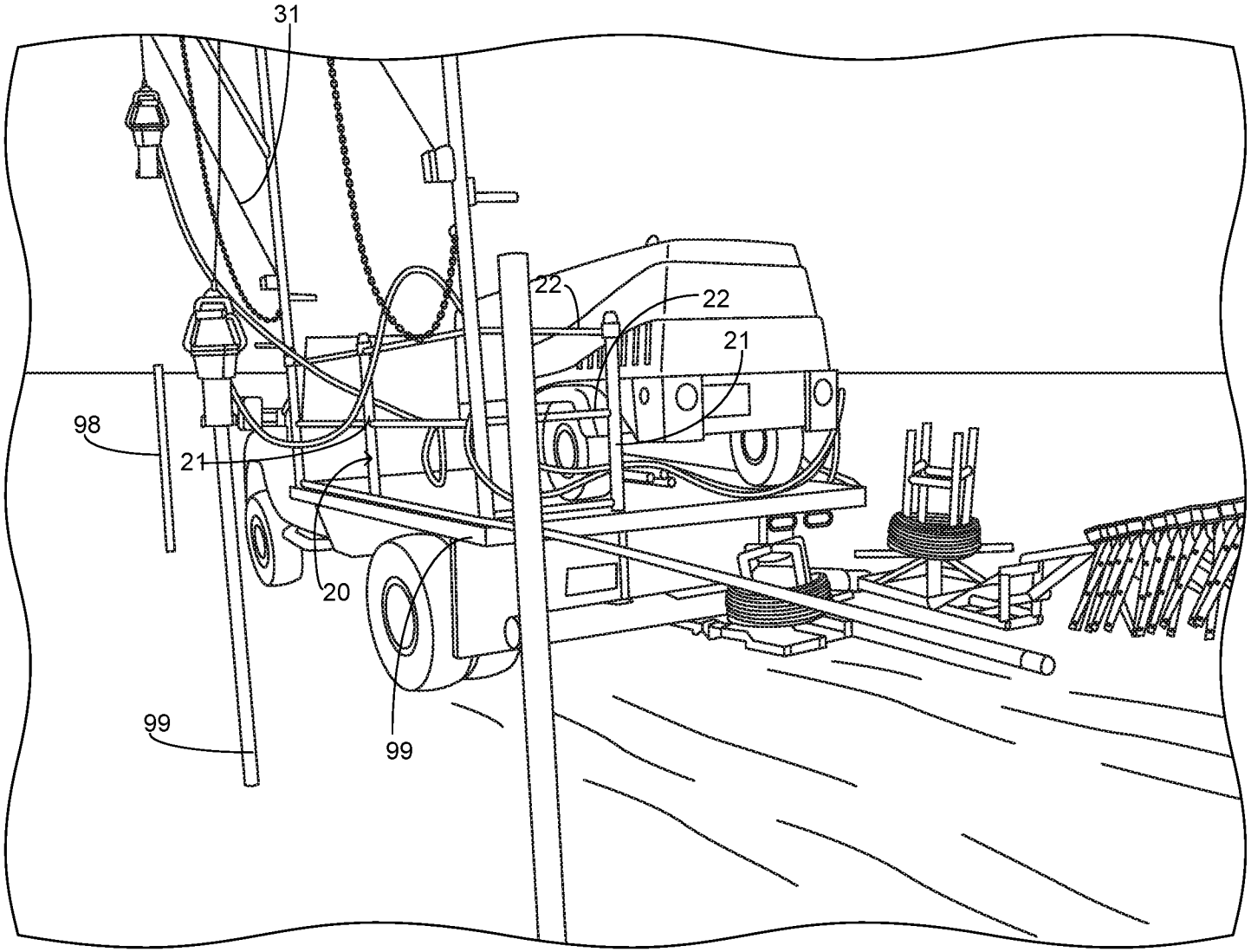
FIG. 4 is a side rear perspective of the present invention.

Referring now to the drawings submitted herewith, wherein various elements depicted therein are not necessarily drawn to scale and wherein through the views and figures like elements are referenced with identical reference numerals, there is illustrated a fence installation apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring to the Figures submitted as a part hereof, the fence installation apparatus 100 includes a drive assembly support frame 10 that is operably coupled to vehicle 99. The drive assembly support frame 10 includes a rear support member 12 and a front support member 14 that are secured to the bed of the vehicle 99 utilizing suitable techniques. The rear support member 12 and front support member 14 are manufactured from a rigid material such as but not limited to metal tubing and extend upward from the bed of the vehicle 99. It should be understood within the scope of the present invention that the rear support member 12 and front support member 14 could be provided in alternate lengths so as to accomplish the desired tasks of the fence installation apparatus 100 as described herein. The rear support member 12 includes end member 13 secured thereto distal to the bed of the vehicle 99. End member 13 is formed perpendicular to the rear support member 12 and extends away from the vehicle 99. End member 13 is further supported by brace member 15. The front support member 14 further has an end member 16 secured thereto and is similar to end member 13 in size and orientation. The end member 16 has secured thereto brace members 17 for structural support.

Secured to the bed of the vehicle 99 proximate the lower end 9 of the drive assembly support frame 10 is the safety cage member 20. The safety cage member 20 is configured to provide a safety railing along the bed of the vehicle 99 particularly on the side and rear portion thereof. The safety cage member 20 is comprised of a plurality of vertical post members 21 and horizontal post members 22 arranged in a suitable manner so as to achieve the desired objective. It should be understood within the scope of the present invention that the horizontal post members 22 and vertical post members 21 could be arranged in various manners in order to construct the safety cage member 20 that provides a barrier to inhibit an individual from falling from the bed of the vehicle 99.

The drive assembly support frame 10 is configured to provide operational of the first drive member 25 and second drive member 30. The first drive member 25 and second drive member 30 are operably coupled to the rear support member 12 and front support member 14 respectively. The first drive member 25 and second drive member 30 are configured to operably engage the exemplary fence posts 98 and drive into the ground wherein the first drive member 25 and second drive member 30 can be operated simultaneously so as to facilitate the installation of two fence posts 98 at the same time. The first drive member 25 is operably coupled to the rear support member 12 utilizing cable 26 wherein the cable 26 is secured to end member 13 with pulley 27. The cable 26 and pulley 27 provide the ability for the first drive member 25 to move in a downward movement during installation of a fence post 98 and then be returned to be proximate the end member 13 for preparation of the next fence posts 98. The second drive member 30 is identically mounted as the first drive member 25 utilizing cable 31 and pulley 32. In a preferred embodiment the first drive member 25 and second drive member 30 are air hammers that are operated via exemplary compressor 97 to provide the necessary force to drive the fence posts 98 into the ground. While the drive assembly support frame 10 is illustrated having the necessary components to operably mount two drive members, it is contemplated within the scope of the present invention that the fence installation apparatus 100 could employ a single drive member or more than two drive members. Furthermore, while in the preferred embodiment of the present invention the first drive member 25 and second drive member 30 are air hammers, it is contemplated within the scope of the present invention that alternate tools could be employed such as but not limited to augers configured to form holes in the ground in preparation for a different style of fence posts 98.

The fence installation apparatus 100 further includes a first wire dispenser 50 operably coupled proximate the rear of the vehicle 99. The first wire dispenser 50 is configured to provide the ability to dispense wire as the vehicle 99 moves along the fence line during installation of the fence posts 98. As is known in the art, construction of a chain link style fence utilizes tension wires. The first wire dispenser 50 can be loaded with a spool of tension wire wherein the tension wire is distributed along the fence line for installation. The first wire dispenser 50 includes support platform 52 that is planar in manner and positioned generally parallel to the ground. The support platform 52 has rotatably secured thereto a wire support assembly 54. The wire support assembly 54 is configured to have an exemplary spool of wire 96 mounted thereto. The wire support assembly 54 includes support arms 56 that extend outward from the center of the wire support assembly 54 that are operable to provide support of the wire spool 96. It is contemplated within the scope of the present invention that the wire support assembly 54 could employ various quantities and configurations of the support arms 56. The first wire dispenser 50 includes center support member 58 that is operably coupled to the support arms 56 and extends upward therefrom. The center support member 58 extends upward from the support arms 56 and is configured to have a spool of wire circumferentially mounted thereto. While the center support member 58 is illustrated having a particular structure herein, it is contemplated within the scope that the center support member 58 could be formed in alternate styles and shapes and achieve the desired objective stated herein.

The fence installation apparatus 100 further includes a second wire dispenser 60. The second wire dispenser 60 is additionally configured to provide the distribution of wire along the fence line during installation of fence posts 98. The second wire dispenser 60 includes support platform 62 that is planar in manner and positioned so as to be generally horizontal to the ground.. The support platform 62 has rotatably secured thereto a wire support assembly 64. The wire support assembly 64 is configured to have an exemplary spool of wire 96 mounted thereto. The wire support assembly 64 includes support arms 66 that extend outward from the center of the wire support assembly 64 that are operable to provide support of the wire spool 96. It is contemplated within the scope of the present invention that the wire support assembly 64 could employ various quantities and configurations of the support arms 66. The second wire dispenser 60 includes center support member 68 that is operably coupled to the support arms 66 and extends upward therefrom. The center support member 68 extends upward from the support arms 66 and is configured to have a spool of wire circumferentially mounted thereto. The center support member 68 extends upward at a distance that is great than that of the center support member 58 so as to inhibit tangling of wire 93. It should be understood within the scope of the present invention that the center support member 68 could be provided in alternate configuration and heights.

The second wire dispenser 60 includes pole mount 70 and pole member 72 operably coupled thereto. The pole mount 70 and pole member 72 function to provide the ability to position fence accessories such as but not limited to barb wire support arms 95 during the installation of a fence. The pole mount 70 is manufactured from durable rigid material such as but not limited to metal and is formed to provide the necessary structural support for the pole member 72. Pole member 72 is hollow so as to permit the wire 93 to be journaled therethrough allowing the barb wire support arms 95 to be operably coupled therewith during the process of installing a fence using the fence installation apparatus 100. The pole member 72 is positioned at an upward angle so as to receive an maintain position of the barb wire support arms 95. It is contemplated within the scope of the present invention that the pole member 72 could be provided in alternate lengths. Furthermore, in a preferred embodiment, the pole member 72 is mounted wherein the pole member 72 is further angled slightly inward to the fence line. While the fence installation apparatus 100 is illustrated and discussed herein as having a first wire dispenser 50 and a second wire dispenser 60, it is contemplated within the scope of the present invention that the fence installation apparatus 100 could employ only one wire dispenser or more than two wire dispensers.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A fence installation apparatus operably coupled to a vehicle configured to facilitate installation of a fence as the vehicle traverses along a desired fence line wherein the fence installation apparatus comprises:

a drive assembly support frame, said drive assembly support frame being operably coupled to a suitable vehicle, said drive assembly support frame having a rear support member and front support member, said rear support member extending upward from said vehicle and being proximate a rear area thereof, said front support member being coupled to the vehicle and extending upward therefrom, said rear support member and said front support member being mounted along a side of the vehicle;

a first drive member, said first drive member being operably coupled to the rear support member, said first drive member operable to drive a fence post into a ground on which the vehicle is superposed;

a first wire dispenser, said first wire dispenser being mounted to the vehicle proximate the rear area thereof, said first wire dispenser having a support platform and a wire support assembly, said support platform being parallel with the ground, said wire support assembly being rotatably mounted to said support platform, said first wire dispenser configured to receive and dispense a spool of wire; and a second wire dispenser, said second wire dispenser being mounted to the vehicle proximate the rear area thereof adjacent to said first wire dispenser, said second wire dispenser having a support platform and a wire support assembly, said support platform of said second wire dispenser being parallel with the ground, said wire support assembly of said second wire dispenser being rotatably mounted to said support platform of said second wire dispenser, said second wire dispenser having a spool of wire mounted thereon; and a pole mount and a pole member, said pole mount and said pole member operably coupled to said second wire dispenser, said pole member extending away from said second wire dispenser and further having an upward angle thereto, said pole member being hollow, said pole member having a portion of the wire mounted to the second wire dispenser journaled through.

2. The fence installation apparatus as recited in claim 1, and further including a second drive member, said second drive member being operably coupled to the front support member, said second drive member operable to drive a fence post into the ground.

3. The fence installation apparatus as recited in claim 2, wherein said first drive member is movably mounted with a cable and pulley so as to permit an upwards-downwards movement thereof.

4. The fence installation apparatus as recited in claim 3, and further including a safety cage member, said safety cage member being secured to the vehicle, said safety cage member constructed to inhibit a user from falling off the vehicle during use of the fence installation apparatus.

* * * * *